United States Patent [19]

Goins

[11] 4,033,411

[45] July 5, 1977

[54] METHOD FOR STIMULATING THE RECOVERY OF CRUDE OIL

[76] Inventor: John T. Goins, 2301 Nassau Drive, Seabrook, Tex. 77586

[22] Filed: Jan. 2, 1976

[21] Appl. No.: 646,253

Related U.S. Application Data

[63] Continuation-in-part of Ser. No. 547,355, Feb. 5, 1975, abandoned.

[52] U.S. Cl. ..... 166/257; 166/303; 166/304

[51] Int. Cl.[2] ..... E21B 43/24

[58] Field of Search ..... 166/57, 257, 59, 302, 166/303, 304, 272, 273, 274

[56] References Cited

UNITED STATES PATENTS

| | | | |
|---|---|---|---|
| 2,421,528 | 6/1947 | Steffen | 166/303 |
| 2,444,755 | 7/1948 | Steffen | 166/59 |
| 2,514,259 | 7/1950 | Roberts | 166/273 |
| 2,964,109 | 12/1960 | Martin | 166/273 |
| 3,061,009 | 10/1962 | Shirley | 166/303 |
| 3,221,810 | 12/1965 | Marx | 166/274 |
| 3,360,044 | 12/1967 | Lange | 166/172 |
| 3,478,825 | 11/1969 | Closmann | 166/303 |
| 3,730,270 | 5/1973 | Allred | 166/303 |
| 3,768,559 | 10/1973 | Allen et al. | 166/272 |
| 3,837,401 | 9/1974 | Allen | 166/303 |

*Primary Examiner*—James A. Leppink
*Attorney, Agent, or Firm*—W. F. Hyer; Marvin B. Eickenroht

[57] ABSTRACT

There are disclosed several embodiments of a method for stimulating the recovery of crude oil from a formation penetrated by a well bore. In each embodiment, a mixture of the vapors of a solvent for the crude oil and gas which is a product of combustion is injected into the formation.

13 Claims, 7 Drawing Figures

METHOD FOR STIMULATING THE RECOVERY OF CRUDE OIL

This application is a continuation-in-part of my copending application, Ser. No. 547,355, filed Feb. 5, 1975, and entitled "Method and Means for Oil Formation Stimulation" now abandoned.

This invention relates to an improved method for recovering crude oil from a formation which is penetrated by a well bore; and, more particularly, to such a method of this type which is especially useful in the recovery of low API gravity crude oil. Although principally useful in the secondary recovery of such crude oil, this invention may also be useful in the primary recovery thereof.

Crude oil of this type, which is commonly known as "heavy" oil, is characterized by its high specific gravity and high viscosity. For example, it may have an API gravity of 25° or less and a viscosity above 30 c.p. Also, water-in-oil emulsions and unstable dispersions of asphaltenes and waxes are ordinarily present in the formation. Although often found at relatively shallow depths, it is difficult if not impossible to produce such oil without resort to secondary recovery processes. Thus, even though shallow depths facilitate recovery of lighter crude oil, they complicate the recovery of the heavy crude oil because, being closer to ground level, it's cooler and thus more viscous, and the natural gas drive in the formation tends to be depleted.

Of the known methods for stimulating the recovery of such crude oil, dilution with solvents for the crude oil and displacing and/or raising temperature of the crude oil with steam are probably the most effective. However, flooding with liquid solvents alone requires such a large volume of same as to be economically impractical. Hence, it has been proposed to inject a slug of the solvent into the formation in front of a water or steam drive in an effort to reduce the viscosity of the crude oil. However, since nearly all formations of interest to the petroleum industry contain clays and other minerals which are sensitive to fresh water, recovery processes which utilize steam are limited in their range of application. Thus, steam condensate upsets the environment of the interstitial formation brine and the equilibrium of the clays and other minerals causing them to disperse in flow channels and to be carried downstream until they lodge in constrictions. Miniature filter cakes are formed by these obstructions, plugging the pores and reducing permeability according to the fraction of pores plugged. Steam strips the crude oil from the clay formation causing fines to disperse, and these fines act to stabilize viscous oil-in-water emulsions. It also causes swelling of the clay which reduces oil flow by closing the pores. Also, of course, stream condensate is immiscible with in situ hydrocarbons causing emulsions to form. As a consequence, the use of steam damages the formation to the extent that production is limited and the formation production capacity is eventually destroyed.

It has also been proposed to use carbon dioxide ($CO_2$) as an assist in dispersing stimulants deeper into the formation. Although soluble within the crude oil, when pumped into the well bore in liquid form, $CO_2$ draws its heat of vaporization as it expands from the situ hydrocarbons and the formation, thus increasing the viscosity of the crude oil.

The object of this invention is to provide a method of stimulating the recovery of crude oil which avoids the above-described and other problems of prior methods, without sacrificing the advantages thereof.

This and other objects are accomplished, in accordance with the present invention, by the injection into the formation of a mixture of vapors of the solvent and gas which is a product of combustion. Similarly to prior solvent stimulation processes, this stimulates recovery of the crude oil without damage thereto, but at much lesser expense due to the volume of the vapors. Thus, as the solvent vapors condense upon injection into the formation, its heat of vaporization is transferred to the crude oil to reduce its specific gravity, dilute the waxes and asphaltenes, reduce its viscosity to accelerate the flow of crude oil, leach the pore channels in the reservoir clean by reflux condensing, break up emulsions in the crude oil by reducing its surface tension, reduce the surface tension between the crude oil and the rock formation by diluting same, and create favorable production sump conditions.

On the other hand, the mixture of solvent vapors and combustion gas do not cause formation water sensitivity or emulsions, or introduce alien products into the crude oil. The combustion gas dissolves in the interstitial brine so as to lower the pH which results in a favorable environment for the clay and other minerals and minimizes water sensitivity. In addition to promoting dispersion of the solvent vapors entrained therein throughout the formation, the combustion gas is miscible with both the crude oil and the solvent so as to eliminate emulsion formation. Also, being soluble in the crude oil in the formation, combustion gas produces a further reduction in the viscosity of the crude oil. Any undissolved gas acts as a potential drive energy source for producing the crude oil. Still further, as compared with prior uses of liquid solvents, the solvent vapor, in addition to reducing the cost of the process by its increase in volume, heats a large area of the formation, thus promoting a reduction in specific gravity of the crude oil and creating an artificial pressure which augments the pressure of the combustion gas and thus further promotes movement of the crude oil into the well bore.

The method of the present invention is not only useful in stimulating recovery of crude oil from the well bore into which the mixture is injected, but also in recovering crude oil from other well bores which penetrate the formation in surrounding areas, which may be a substantial distance from the injection well bore. This invention also contemplates that after use of the method in stimulating recovery of the crude oil, the solvent vapors and combustion gas may be used in slug fashion followed by a suitable salt water flood to further reduce the expense of the solvent by recovering it in an adjacent well bore.

A selection of a suitable solvent will be obvious to a person skilled in the art, having in mind the desire of avoiding damage to the formation and achieve the desired dilution of the crude oil. By way of example, suitable solvents are methane, ethane, propane, n-butane, isobutane, *n*-pentane, isopentane, *n*-hexane, *n*-hectane, *n*-octane, *n*-nonane, *n*-decane, toluene, and conventional gasoline.

Preferably, the solvent is vaporized and mixed with the combustion gas at the well site. In accordance with one embodiment of the invention, the solvent may be vaporized at ground level, and then conducted downwardly into the well bore for mixture in a mixing chamber adjacent the formation with combustion gas, which may be $CO_2$, and which is also conducted downwardly from a source at ground level through another tubing extending into the mixing chamber. In accordance with other embodiments of the invention, the combustion gas is produced at the well site by the ignition of an oxidizer with a portion of the solvent, the combustion process producing the heat necessary to vaporize the remainder of the solvent, and the resulting combustion gas and solvent vapors being mixed in the combustion chamber prior to injection into the formation. In accordance with one such embodiment, the combustion occurs within a chamber at ground level, and in accordance with another embodiment, the combustion occurs within a combustion chamber within the well bore adjacent the formation.

In all the embodiments of the invention, solvent vapor and combustion gas, or the mixture of the two, are conducted downwardly within the well bore for injection in the formation through one or more tubing strings extending through the wellhead, and with the outer string being packed off above perforations in the formation through which the mixture is injected. This of course reduces the space through which the combustion gas and solvent vapors, or mixture of the two, must be conducted prior to injection into the well bore. Also, of course, this reduces the heat loss which would otherwise occur if the conduction were through the casing or portion of the well bore in the annular space surrounding the tubing. Still further, this permits the method to utilize existing apparatus for producing the crude oil from the well bore, either during primary recovery or secondary recovery resulting from the stimulation process.

The mixture is caused to be injected into the formation by the pumps which cause the solvent vapors and combustion gas to be conducted through the tubing, either separately or as a mixture. The rate at which the mixture is pumped into the formation depends, of course, primarily on the pressure at the bottom of the well bore, which in turn depends on the rate at which the mixture penetrates the formation. Thus, if the bottom hole pressure builds up, the operator knows that he must increase the pumping rate so as to accomplish faster penetration. Fluctuations in bottom hole pressure which might be experienced during the process will be similar to those which are experienced during formation fracturing, but on a much lower scale, and one skilled in the art would be guided accordingly.

In the drawings, wherein like reference characters are used throughout to designate like parts:

Figure 4:
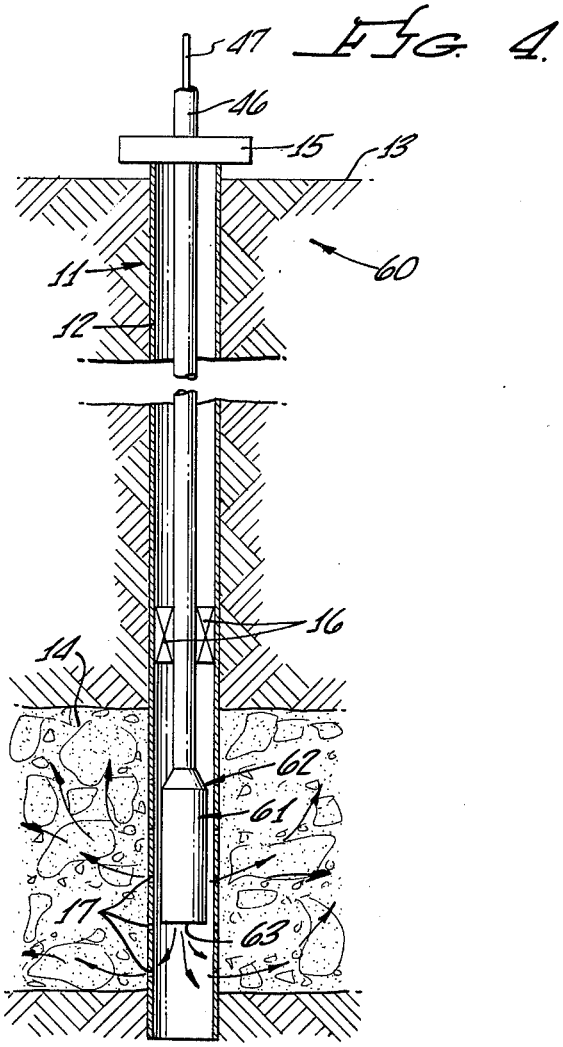
FIG. 4 is a view similar to FIGS. 1 and 2, but illustrating apparatus for use in stimulating such recovery in accordance with the third described embodiment of the method.
Figure 5:
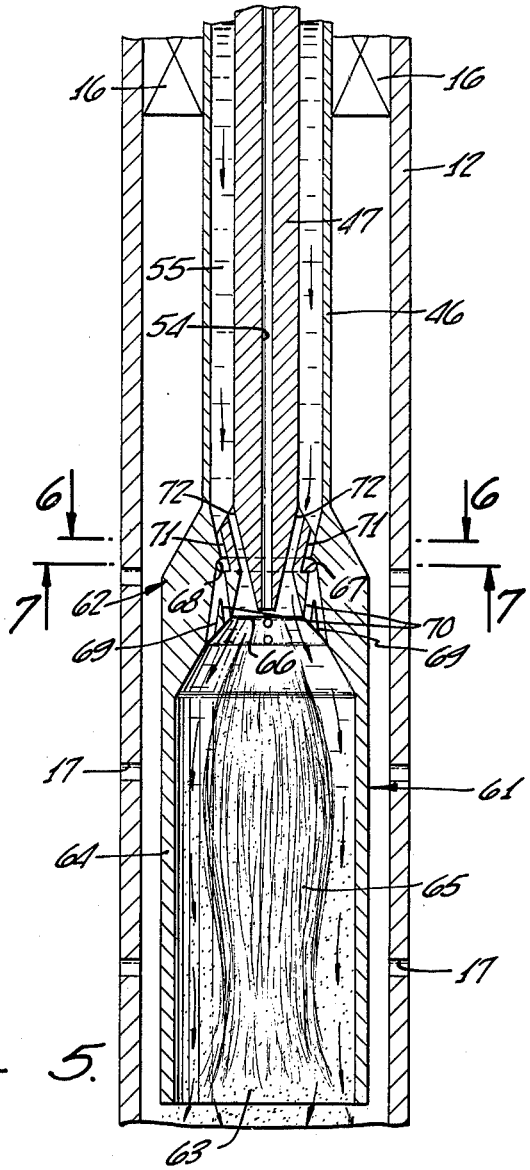
Figure 6:
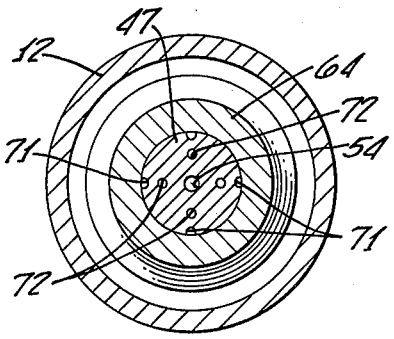
Figure 7:
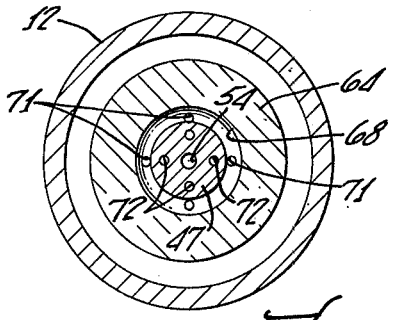
Figure 1:
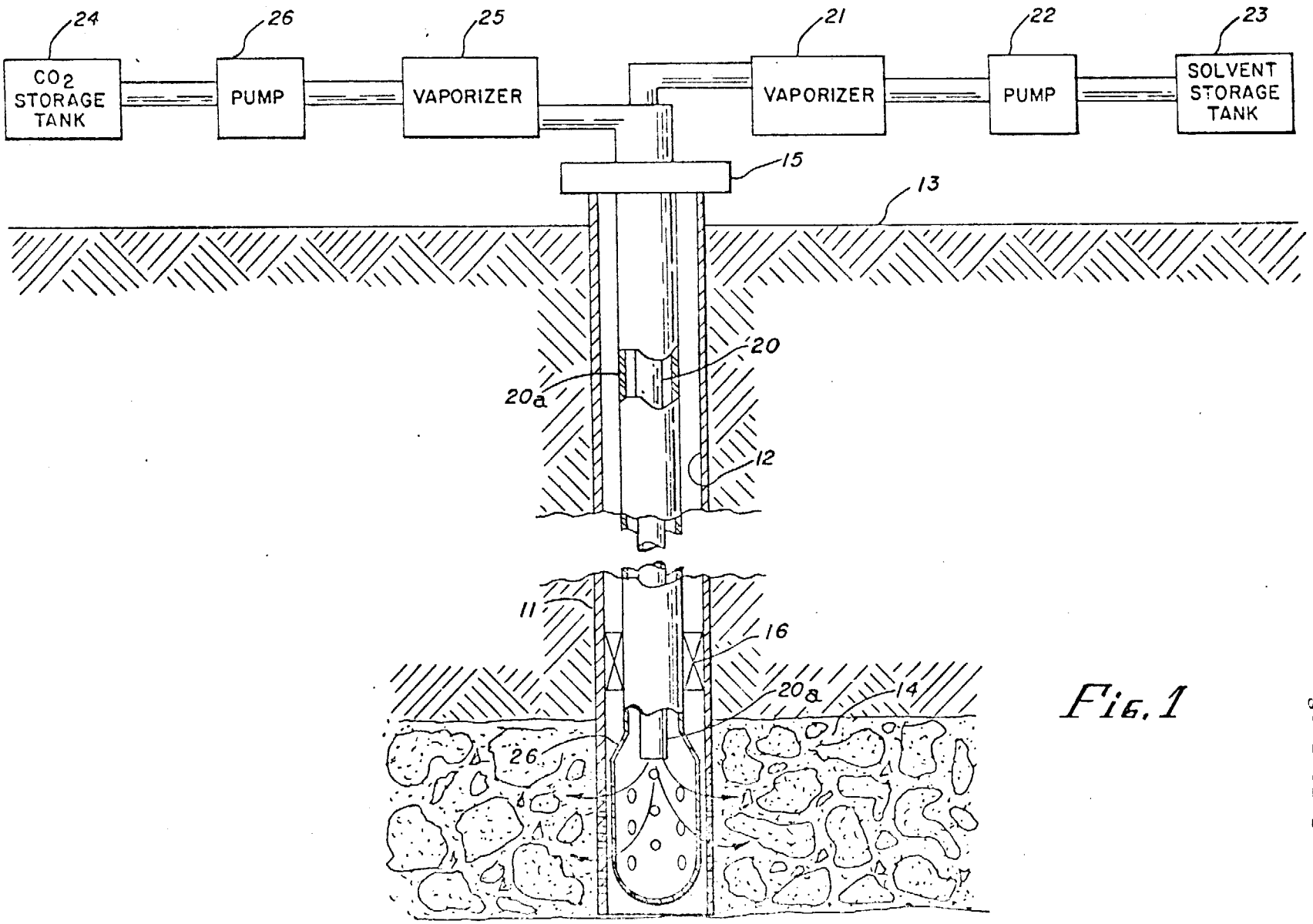
Figure 1:
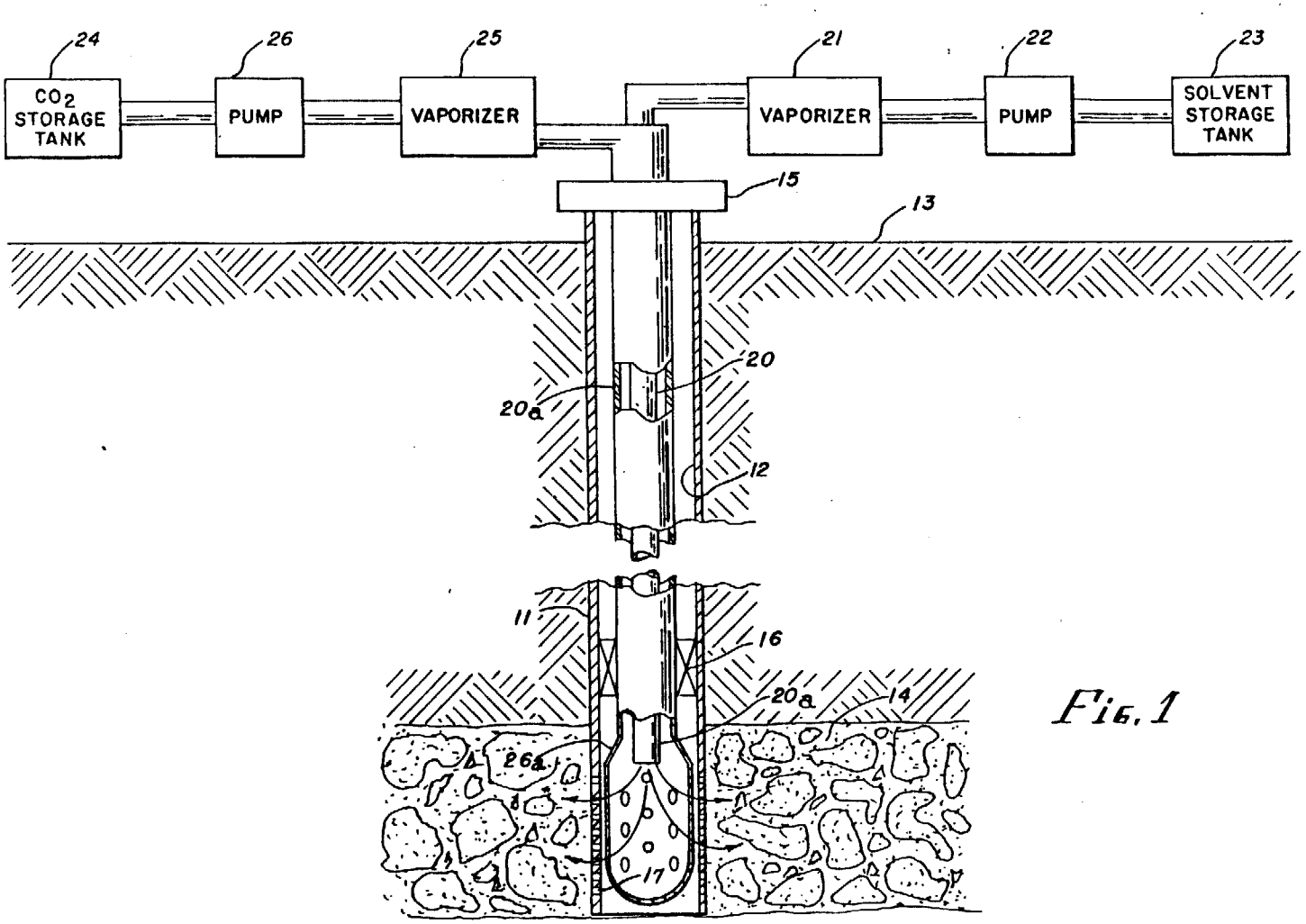

FIG. 5 is an enlarged vertical sectional view of the combustion chamber of the apparatus of FIG. 4 and the adjacent portions of the well bore in which it is disposed; and FIGS. 6 and 7 are enlarged cross-sectional views of the combustion chamber of FIG. 5, as seen along broken lines 6—6 and 7—7 thereof, respectively.

Figure 1:
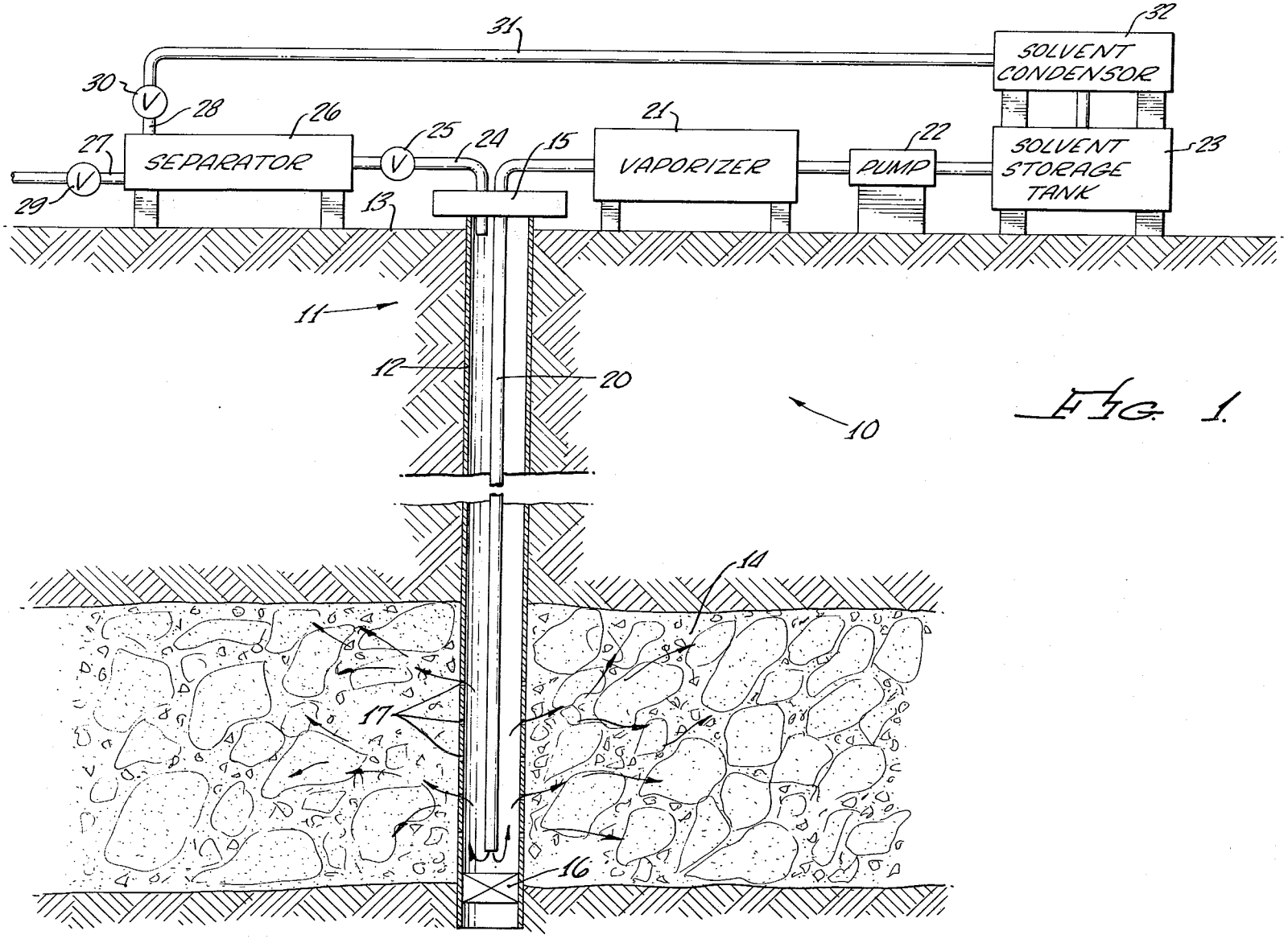
FIG. 1 is a cross-sectional view of a formation which is penetrated by a well bore, together with a diagrammatic illustration of apparatus for use in stimulating the recovery of crude oil therefrom in accordance with the first described embodiment of the method of the present invention.

As shown in FIG. 1, a crude oil bearing formation 14 has been penetrated by a well bore 11 which has been drilled downwardly from ground level 13. More particularly, the well bore is lined with a casing 12 which has perforations 17 therethrough at the formation level. Thus, crude oil from the formation may be recovered through a tubing string 20*a* extending through a wellhead 15 closing the upper end of the casing. As is common practice, the annulus between the tubing and casing is closed off above the formation by a packer 16, so that the crude oil is confined for passage into the open lower end of tubing 20*a*.

When the method of the present invention is used as a secondary recovery process, lighter crude oil would have already been produced from the formation by means of natural gas pressure and/or other secondary recovery methods. Alternatively, the well bore may be drilled and cased, and the tubing set, as described, for the purpose of primary recovery of crude oil in accordance with the method to be described. Still further, and as previously mentioned, it is contemplated that the well bore may be used merely as a means of injecting fluids into formation 14 so as to stimulate recovery of crude oil from other well bores penetrating the formation.

In any event, in accordance with this first embodiment of the present invention, another tubing string 20 is disposed concentrically within outer tubing 20*a*, with its upper end extending through the outer tubing above wellhead 15. Upon passage downwardly through the tubing strings, the carbon dioxide mixes with the solvent vapor in a radially enlarged mixing chamber 26 installed on the lower end of outer tubing 20*a*. Since solvent vapor is supplied to the inner tubing 20 and carbon dioxide is supplied to outer tubing 20*a*, there is a minimum of heat loss from the vapors. As shown in FIG. 1, the inner tubing string 20 terminates near the entrance to the mixing chamber, and the chamber has ports in its side walls and bottom so that the mixture of gas and vapors is diffused evenly within the well bore prior to being injected into the formation.

As also shown in FIG. 1, the solvent which is to be vaporized is stored within a tank 23 mounted on ground level 13 at a location relatively near the wellhead 15. The solvent is drawn from the tank into the vaporizer or boiler 21 by means of a pump 22, and is heated in the vaporizer to a temperature sufficient to form and maintain it in vapor form at the pressure existing at the level of the well bore in which it is to be mixed with the carbon dioxide. Thus, as shown, the vaporizer is connected to the upper end of inner tubing string 20*a*, whereby pump 22 will supply the vapor to the formation at a desired rate and pressure.

As also shown in FIG. 1, carbon dioxide is stored in a tank 24 in a location which is also preferably near wellhead 15. The carbon dioxide is drawn from the tank 24 in liquid form by means of a pump 26, and delivered into a vaporizer 25 where it is converted into a vapor at a pressure for maintaining it in vaporized form in the mixing chamber 26. As in the case of the solvent vapors, the carbon dioxide is pumped downwardly through tubing string 20 into the diffuser for mixture with the solvent vapor. Although a source of combustion gas other than $CO_2$ may be used, the latter is preferred, not only because of its availability but also because of the absence therefrom of nitrogen.

As indicated by the arrows in FIG. 1, the pressure from both pumps 22 and 26 will force the mixture of gas and vapors outwardly from the mixing chamber and into the well bore for injection into the formation through perforation 17. As previously mentioned, the rate at which the gas and vapor are supplied by the pumps for this purpose will depend upon a number of factors which will be apparent to one skilled in the art in view of the disclosure of this application.

In practicing the present invention, one skilled in the art may select the relative proportions of combustion gas and solvent vapors best suited to the existing conditions. By way of example, I contemplate that it may be desirable to initially open up the formation by injection of about 420 gallons of $CO_2$ at about 600° Then, solvent and $CO_2$ could be mixed in a ratio of about 1:3 (liquid); and 4,000 gallons thereof injected in the formation. This could be followed by a continued injection of a mixture having a ratio of about 1:2 until the desired results are obtained. Finally, the supply of solvent vapors may be shut off, and about 840 gallons of $CO_2$ injected into the formation to insure complete solvent penetration.

Figure 3:
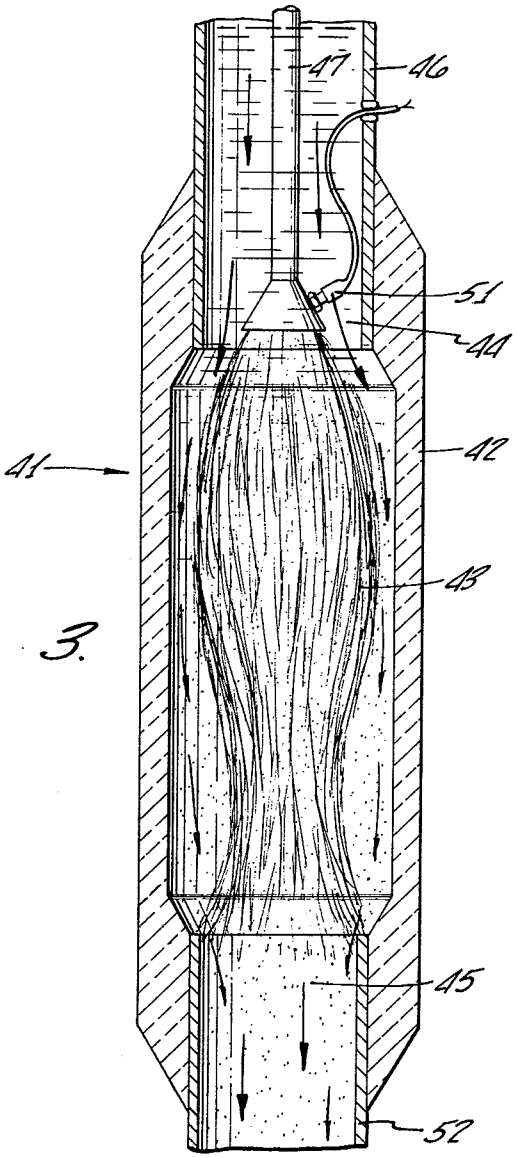
FIG. 3 is an enlarged vertical sectional view of the combustion chamber of the apparatus of FIG. 2.
Figure 2:
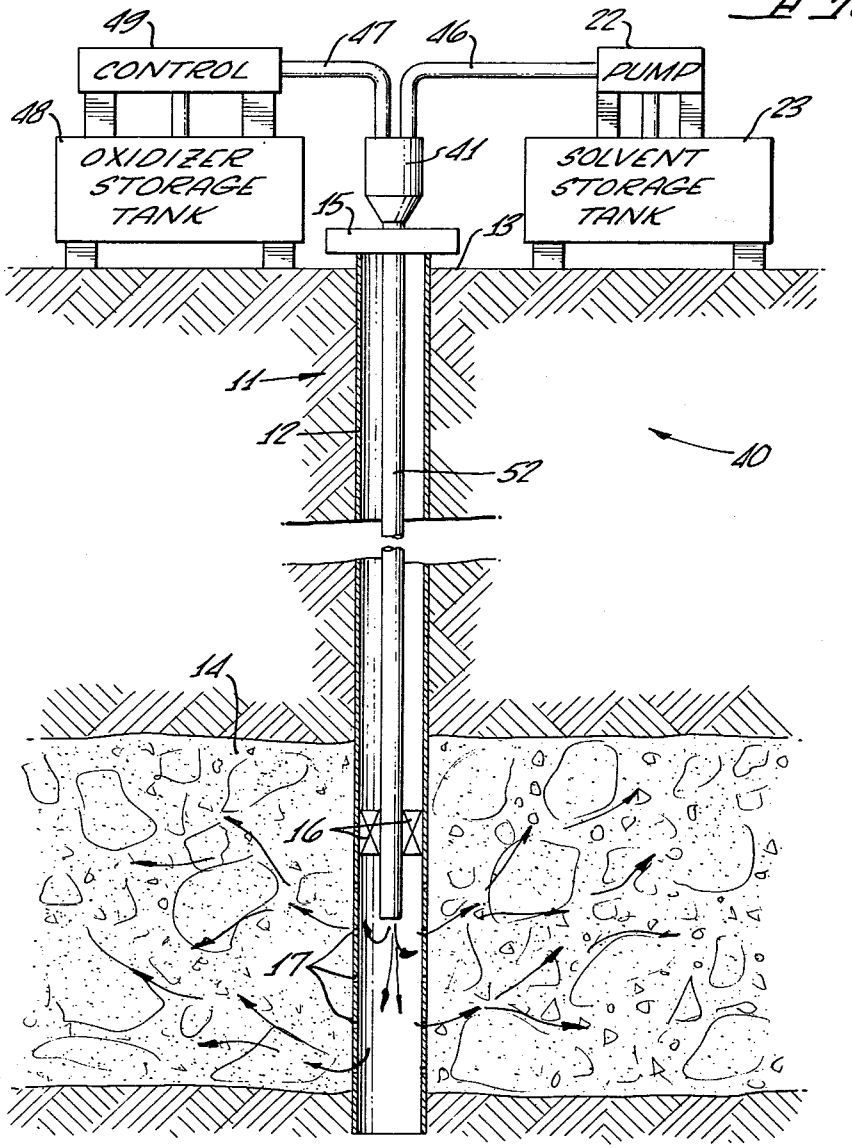
FIG. 2 is a view similar to FIG. 1, but illustrating apparatus for use in stimulating recovery from such a well in accordance with the second described embodiment of the method.

As previously described, in accordance with the second embodiment of the apparatus illustrated in FIGS. 2 and 3, a portion of the solvent is ignited at a well site so as to not only produce combustion gas, but also cause the remainder of the solvent to be vaporized by the heat of combustion, the mixed solvent vapors and combustion gas then being injected into the well. More particularly, in this second embodiment of the invention, as distinguished from the third embodiment to be described, the combustion occurs and the solvent vapors and combustion gas are mixed above ground level, and then conducted downwardly into the well bore for injection into the formation.

Thus, as shown in FIG. 2, a formation 14 is penetrated by a well bore 11 which has been drilled downwardly from ground level 13 and lined with a casing 12 having perforations 17 therethrough at the formation level. Crude oil from the formation may be recovered through a tubing string 52 which extends downwardly through a wellhead 15 closing the upper end of the cased well and packed off by means of a packer 16 above the perforations. Thus, as in the case of the apparatus described in connection with FIG. 1, the apparatus of FIG. 2 is useful not only in practicing the second embodiment of the invention, but also in producing the crude oil from the formation, either as primary or secondary recovery, or both.

In the apparatus shown in FIG. 2, solvent is stored within a tank 23 near the wellhead, and is withdrawn therefrom by means of a pump 22 for delivery to vaporizer 41 by means of conduit 46. In this embodiment of the invention, however, the vaporizer includes a combustion chamber which is shown in more detail in FIG. 3, to be described to follow.

An oxidizer which is stored within a tank 48 also located near the wellhead may be withdrawn therefrom in a controlled manner by means of a control 49, and conducted from the control into the vaporizer 41 by means of a conduit 47. Conduits 46 and 47 may be disposed side-by-side, as shown in FIG. 2, or with the conduit 47 extending concentrically within the conduit 46, as shown in FIG. 3. Preferably, the oxidizer is pure oxygen, because it is easy to handle, and also because the major constituent of the combustion gas is $CO_2$. However, other oxidizers, including air, may be used, especially for economic purposes. Although air contains nitrogen, the products of combustion which contain nitrogen are believed to be immiscible in the crude oil and inert in the formation.

As shown in FIG. 3, the vaporizer 41 comprises a generally cylindrical, thick-walled housing 42 connected to the lower end of conduit 46 to define a combustion chamber 43 at the lower open end of conduit 47. Thus, the upper end of conduit 46 provides an inlet 44 to the combustion chamber, and the lower end of the housing 42 provides an outlet 45 therefrom. In any event, the solvent and oxidizer are introduced into the combustion chamber through their respective conduits, wherein the oxidizer and a portion of the solvent are ignited by a means 51 connecting with the flared lower end of conduit 47 for the oxidizer. As above described, upon ignition of a portion of the solvent, the remainder thereof is vaporized within the combustion chamber 43 and mixed with the combustion gas resulting from the combustion.

This mixture is forced downwardly by means of pump 22 into tubing 52 connecting with the outlet 45 from the combustion chamber. From the lower end of tubing 52, the solvent vapors entrained in the combustion gas are injected outwardly into the formation, as indicated by the arrows in FIG. 2, thus stimulating recovery of the crude oil in the formation in the manner previously described.

The operating temperature in the combustion chamber 43, and thus the desired vaporization of the solvent, is controlled by the flow of oxidizer to the chamber. Thus, the combustion level in the chamber may be raised or lowered by varying the flow rate of the oxidizer by means of control 49.

Although the need for the combustion chamber may cause the apparatus used in practicing this embodiment of the invention to be more expensive than that disclosed in FIG. 1, it has the advantage of reducing heat losses, eliminating the need for a secondary fuel supply, and preventing objectonable gases from being vented into the atmosphere.

As also previously described, the apparatus for use in practicing the third embodiment of the method of the present invention is in many respects similar to that described in connection with FIGS. 2 and 3, with the principal exception being that the combustion chamber for producing combustion gas and vaporizing the solvent is below ground level and within the well bore adjustment the formation. Thus, similarly to FIG. 2, FIG. 4 shows a crude oil bearing formation 14 which has been penetrated by a well bore 11 drilled downwardly from ground level 13 and lined with casing 12 which has perforations 17 at the formation level. Crude oil may thus be recovered from the formation through a tubing string 46 which extends downwardly through the wellhead 15 closing the upper end of the well bore and is packed off by packer 16 above the perforations. The uses to which such apparatus may be put, in addition to stimulating the recovering of crude oil in accordance with the present invention, are similar to those previously described.

Although not shown, it will be understood that solvent may be stored within a tank located adjacent the wellhead and supplied to tubing 46 by means of a pump (not shown). Oxidizer, on the other hand, is also stored within a tank located near the wellhead and supplied to a tubing string 47 by means of a control, similar to that described in connection with FIGS. 2 and 3. As shown in FIGS. 4 and 5, tubing string 47 extends concentrically within outer string 46.

The tubing strings extend downwardly to a vaporizer 61 which is located beneath the packer 16 and generally opposite the formation 14. The vaporizer is similar to vaporizer 41 described in connection with the second embodiment of the invention in that is provides a means in which a portion of the solvent pumped downwardly through outer tubing string 46 is combined with the oxidizer conducted downwardly through inner string 46, and the mixture ignited so as to form combustion gas, the heat of combustion serving to vaporize the remainder of the solvent within the combustion chamber, and the combustion gas and solvent vapors mixing therein before being injected into the adjacent formation.

As shown in FIGS. 5 to 7, vaporizer 61 includes a generally cylindrical, thick-walled housing 64 whose upper end 62 is connected to the lower end of outer string 46, and whose lower end 63 is open to provide an outlet for the mixture of combustion gas and solvent vapors. The inner diameter of the upper end 62 of the housing is reduced at 66 to provide an upwardly facing ledge 67, and an annular recess 68 is formed about the inner diameter of the upper end of the housing just above the ledge. A plurality of orifices 69 and 70 extend through the enlarged inner diameter of the housing to connect the recess with the upper end of combustion chamber 65.

Inner tubing string 47 has a relatively small bore 64 therethrough for conducting oxidizer downwardly into the upper end of chamber 65, and an enlarged lower end which is supported upon the ledge 67. A plurality of orifices 71 and 72 are formed in the enlarged lower end of conduit 47 for connecting the lower end of annulus 55 respectively with the annular recess 68, and thus with orifices 69 and 70, and the upper end of chamber 65. Although not shown, it will be understood that suitable means is provided at the upper end of the chamber for igniting the mixture of oxidizer and portion of the solvent as they enter the combustion chamber.

From the foregoing it will be seen that this invention is one well adapted to attain all of the ends and objects hereinabove set forth, together with other advantages which are obvious and which are inherent to the method.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A method for stimulating the recovery of crude oil from a formation which is penetrated by a well bore, wherein a mixture of vapors of a solvent for the crude oil and gas which is a product of combustion of injected into the formation.

2. A method of the character defined in claim 1, including the further step of forming the mixture from separate sources of vapor and gas.

3. A method of the character defined in claim 1, including the further steps of forming the mixture by igniting a portion of the solvent with an oxidizer.

4. A method for stimulating the recovery of crude oil from a formation which is penetrated by a well bore, comprising the steps of mixing at the well site the vapors of a solvent for the crude oil with gas which is a product of combustion, and injecting the mixture into the formation.

5. A method of the character defined in claim 4, including the further steps of conducting the solvent vapors and gas into the well bore from sources at ground level, and mixing them in the well bore prior to injection into the formation.

6. A method of the character defined in claim 5, wherein the gas is carbon dioxide.

7. A method of the character defined in claim 4, including the further steps of introducing the solvent and an oxidizer into a combustion chamber, and igniting the oxidizer and a portion of the solvent to produce the gas and to vaporize the remainder of the solvent for mixture within the chamber prior to introduction into the well bore.

8. A method of the character defined in claim 7, wherein the combustion chamber is at ground level.

9. A method of the character defined in claim 7, wherein the combustion chamber is disposed within the well bore, and the oxidizer and solvent are separately conducted to the chamber from sources at ground level.

10. A method of the character defined in claim 7, wherein the oxidizer is pure oxygen.

11. A method for stimulating the recovery of crude oil from a formation which is penetrated by a well bore, and wherein a tubing string extending through a head at the upper end of the bore is packed off above the formation, including the steps of conducting the vapors of a solvent for the crude oil and gas which is a product of combustion through the tubing string and a pipe string extending within the tubing string and into a mixing chamber at the lower end of the tubing string, and exerting pressure through the strings to cause the mixture of gas and solvent vapors entrained therein to pass out of the chamber and be injected into the formation.

12. A method for stimulating the recovery of crude oil from a formation which is penetrated by a well bore, and wherein a tubing string extending through a head at the upper end of the bore is packed off above the formation, including the steps of conducting the solvent for the crude oil and an oxidizer through the tubing string and a pipe string extending within the tubing string and into a combustion chamber at the lower end of the tubing string, igniting the oxidizer and a portion of the solvent within the chamber to form combustion gas and vaporize the remainder of the solvent, and exerting pressure through the strings to cause the mixture of gas and solvent vapors entrained therein to pass out of the chamber and be injected into the formation.

13. A method for stimulating the recovery of crude oil from a formation which is penetrated by a well bore, and wherein a tubing string extending through a head at the upper end of the bore is packed off above the formation, including the steps of conducting the solvent for the crude oil and an oxidizer into a combustion chamber at the surface level, igniting the oxidizer and a portion of the solvent to form combustion gas and vaporize the remainder of the solvent, conducting the mixture of gas and solvent vapors entrained therein from the chamber and through the tubing string into the well bore, and exerting pressure through the tubing string to cause the mixture within the well bore to be injected into the formation.

* * * * *

UNITED STATES PATENT OFFICE

CERTIFICATE OF CORRECTION

Patent No. 4,033,411 Dated July 5, 1977

Inventor(s) John T. Goins

It is certified that error appears in the above-identified patent and that said Letters Patent are hereby corrected as shown below:

On the Title Page, the illustrative figure and Fig. 1, should appear as shown on the attached sheet.

Remove reference character "40" from Fig. 2, extend the lead line from reference character "11" of Fig. 2, remove reference character "60" from Fig. 4, and add reference character "46" and its lead line in Fig. 4.

Claim 1, line 4, "of", second occurrence, should read -- is --.

Signed and Sealed this

Seventh Day of March 1978

[SEAL]

Attest:

RUTH C. MASON
Attesting Officer

LUTRELLE F. PARKER
Acting Commissioner of Patents and Trademarks

UNITED STATES PATENT OFFICE

CERTIFICATE OF CORRECTION

Patent No. 4,033,411 Dated July 5, 1977

Inventor(s) John T. Goins

It is certified that error appears in the above-identified patent and that said Letters Patent are hereby corrected as shown below:

On the Title Page, the illustrative figure and Fig. 1, should appear as shown on the attached sheet.

Remove reference character "40" from Fig. 2, extend the lead line from reference character "11" of Fig. 2, remove reference character "60" from Fig. 4, and add reference character "46" and its lead line in Fig. 4.

Claim 1, line 4, "of", second occurrence, should read --is--.

Column 4, lines 37 and 65, change "26" to --26a--.

This certificate supersedes certificate issued March 7, 1978.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*